US009965907B1

(12) United States Patent
Surpi

(10) Patent No.: US 9,965,907 B1
(45) Date of Patent: May 8, 2018

(54) RUNNING CHARACTERISTIC FOR FREQUENT DATA READINGS

(71) Applicant: Lytx, Inc., San Diego, CA (US)

(72) Inventor: Gabriela Surpi, San Diego, CA (US)

(73) Assignee: Lytx, Inc., San Diego, CA (US)

( * ) Notice: Subject to any disclaimer, the term of this patent is extended or adjusted under 35 U.S.C. 154(b) by 124 days.

(21) Appl. No.: 14/965,791

(22) Filed: Dec. 10, 2015

(51) Int. Cl.
*G07C 5/00* (2006.01)
*G07C 5/08* (2006.01)

(52) U.S. Cl.
CPC ..... *G07C 5/0841* (2013.01); *G07C 5/008* (2013.01)

(58) Field of Classification Search
None
See application file for complete search history.

(56) References Cited

U.S. PATENT DOCUMENTS

| | | | | |
|---|---|---|---|---|
| 9,656,621 | B2 * | 5/2017 | Curtis | B60R 16/033 |
| 9,766,625 | B2 * | 9/2017 | Boroditsky | G05D 1/0088 |
| 2008/0147266 | A1 * | 6/2008 | Plante | G07C 5/008 701/33.4 |
| 2011/0304447 | A1 * | 12/2011 | Marumoto | G07C 5/085 340/438 |
| 2013/0066688 | A1 * | 3/2013 | Pinkus | G06Q 10/06 705/7.41 |
| 2015/0170438 | A1 * | 6/2015 | Rosenbaum | G06F 17/00 701/1 |
| 2017/0069144 | A1 * | 3/2017 | Lawrie-Fussey | G07C 5/085 |

* cited by examiner

*Primary Examiner* — Tan Q Nguyen
*Assistant Examiner* — Demetra R Smith-Stewart
(74) *Attorney, Agent, or Firm* — Van Pelt, Yi & James LLP

(57) ABSTRACT

A system for frequent data readings includes an input interface and a processor. The input interface is to receive frequent data readings. The frequent data readings include a newest data reading. The processor is to determine a simplified running characteristic based at least in part on the newest data readings and a last simplified running characteristic, and store the simplified running characteristic.

21 Claims, 7 Drawing Sheets

| Input Data Stream | Number of Measurements Available, this is "m" in the text | Number of Measurements Used to Calculate Rolling Window Average Over 6 Measurements, this is "N" | Exact Moving Average Over the Last 6 Measurements |
|---|---|---|---|
| 46 | 1 | 1 | 46.00 |
| 79 | 2 | 2 | 62.50 |
| 73 | 3 | 3 | 66.00 |
| 89 | 4 | 4 | 71.75 |
| 61 | 5 | 5 | 69.60 |
| 18 | 6 | 6 | 61.00 |
| 11 | 7 | 6 | 55.17 |
| 78 | 8 | 6 | 55.00 |
| 20 | 9 | 6 | 46.17 |
| 43 | 10 | 6 | 38.50 |
| 35 | 11 | 6 | 34.17 |
| 92 | 12 | 6 | 46.50 |
| 73 | 13 | 6 | 56.83 |
| 80 | 14 | 6 | 57.17 |
| 82 | 15 | 6 | 67.50 |
| 85 | 16 | 6 | 74.50 |
| 90 | 17 | 6 | 83.67 |
| 98 | 18 | 6 | 84.67 |
| 100 | 19 | 6 | 89.17 |
| 110 | 20 | 6 | 94.17 |
| 115 | 21 | 6 | 99.67 |
| 106 | 22 | 6 | 103.17 |
| 120 | 23 | 6 | 108.17 |
| 135 | 24 | 6 | 114.33 |
| 141 | 25 | 6 | 121.17 |

FIG. 3

| Input Data Stream | Number of Measurements Available, this is "m" in the text | Number of Measurements Used to Calculate Rolling Window Average Over 6 Measurements, this is "N" | Approximated Moving Average Over the Last 6 Measurements |
|---|---|---|---|
| 46 | 1 | 1 | 46.00 |
| 79 | 2 | 2 | 62.50 |
| 73 | 3 | 3 | 66.00 |
| 89 | 4 | 4 | 71.75 |
| 61 | 5 | 5 | 69.60 |
| 18 | 6 | 6 | 61.00 |
| 11 | 7 | 6 | 52.67 |
| 78 | 8 | 6 | 58.97 |
| 20 | 9 | 6 | 49.17 |
| 43 | 10 | 6 | 45.64 |
| 35 | 11 | 6 | 37.92 |
| 92 | 12 | 6 | 43.81 |
| 73 | 13 | 6 | 50.92 |
| 80 | 14 | 6 | 60.69 |
| 82 | 15 | 6 | 61.31 |
| 85 | 16 | 6 | 70.42 |
| 90 | 17 | 6 | 77.08 |
| 98 | 18 | 6 | 86.06 |
| 100 | 19 | 6 | 87.22 |
| 110 | 20 | 6 | 92.64 |
| 115 | 21 | 6 | 97.64 |
| 106 | 22 | 6 | 100.72 |
| 120 | 23 | 6 | 105.97 |
| 135 | 24 | 6 | 112.64 |
| 141 | 25 | 6 | 118.78 |

FIG. 4

RUNNING CHARACTERISTIC FOR FREQUENT DATA READINGS

BACKGROUND OF THE INVENTION

Modern vehicles (e.g., airplanes, boats, trains, cars, trucks, etc.) can include a vehicle event recorder in order to better understand the timeline of an anomalous event (e.g., an accident). A vehicle event recorder typically includes a set of sensors, e.g., video recorders, audio recorders, accelerometers, gyroscopes, vehicle state sensors, GPS (global positioning system), etc., that report data, which is used to determine the occurrence of an anomalous event. Sensor data can then be transmitted to an external reviewing system. Anomalous event types include accident anomalous events, maneuver anomalous events, location anomalous events, proximity anomalous events, vehicle malfunction anomalous events, driver behavior anomalous events, or any other anomalous event types. A vehicle event recorder can additionally record and process sensor data in order to determine information about vehicle parameters, driver behavior, etc. However, the vehicle event recorder has limited resources—for example, the vehicle event recorder has finite memory and so cannot store an infinite amount of data.

BRIEF DESCRIPTION OF THE DRAWINGS

Various embodiments of the invention are disclosed in the following detailed description and the accompanying drawings.

FIG. 3 is a diagram illustrating an embodiment of a calculation of a moving average.

FIG. 4 is a diagram illustrating an embodiment of a calculation of an approximate moving average.

DETAILED DESCRIPTION

Figure 1:
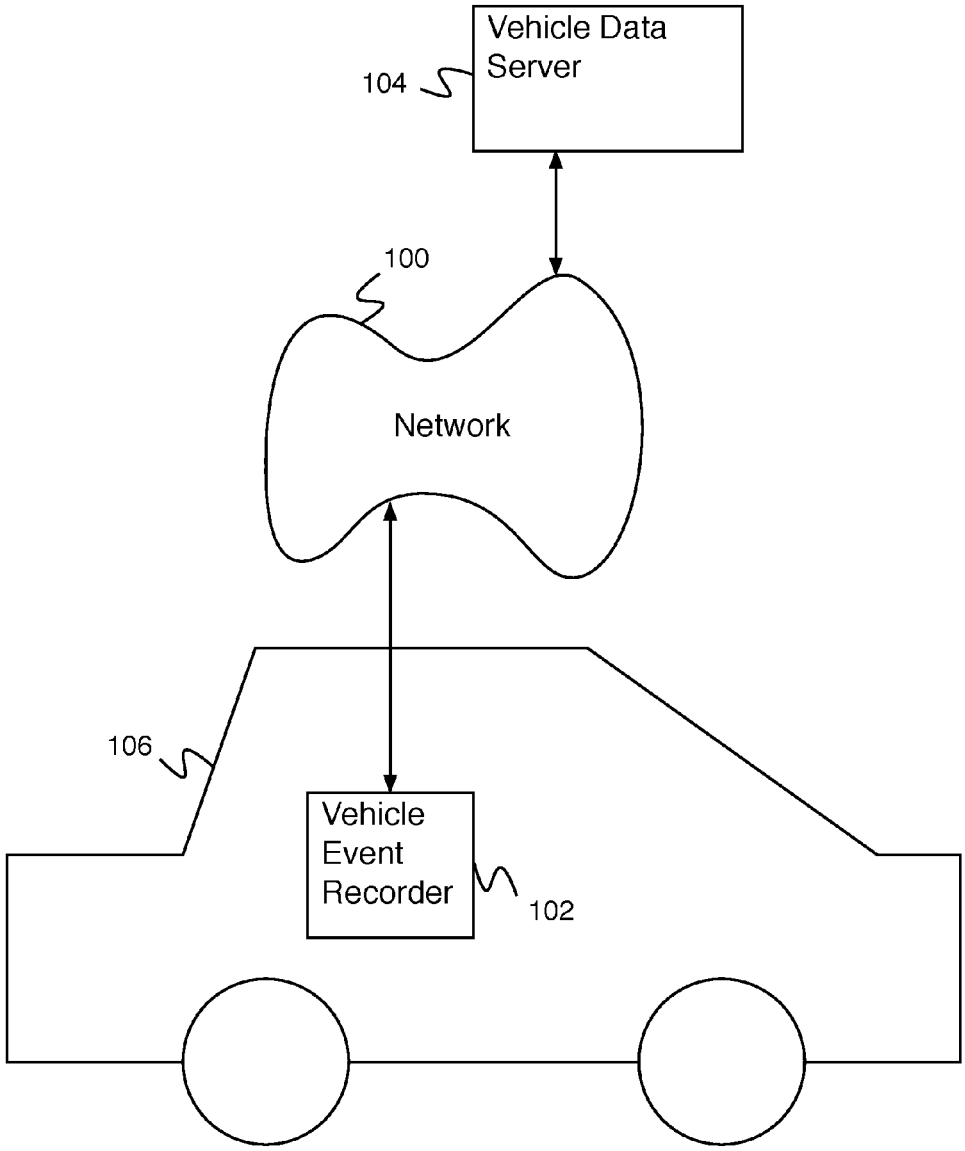
FIG. 1 is a block diagram illustrating an embodiment of a system including a vehicle event recorder.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

A system for frequent data readings is disclosed. The system includes an input interface and a processor. The input interface is to receive frequent data readings. The frequent data readings include a newest data reading. The processor is to determine a simplified running characteristic based at least in part on the newest data readings and a last simplified running characteristic, and store the simplified running characteristic. In some embodiments, the processor is coupled to a memory and the memory is configured to provide the processor with instructions.

In some embodiments, a system for determining in a simplified running characteristic from frequent data readings comprises an input interface to receive frequent data readings and a processor to calculate and store the approximation of a characteristic over a rolling window of N data readings without requiring the storage of any data readings; wherein the simplified running characteristic is determined based on N, the newest data reading and the last approximated characteristic stored.

In some embodiments, a system for a running characteristic for frequent data readings comprises a system for frequent data readings mounted on vehicle (e.g., as part of a vehicle event recorder). In some embodiments, the system is coupled to a set of sensors (e.g., accelerometers, GPS, vehicle state sensors, etc.). The system receives a stream of frequent data readings (e.g., frequent sensor data readings). In order to make the event recorder more efficient, the event recorder, instead of storing each of the stream of frequent data readings, determines a simplified running characteristic based at least in part on the stream of frequent data readings. In some embodiments, the simplified running characteristic comprises a single value or a predetermined set of values (e.g., within a rolling window) that is updated each time a data reading of the stream of frequent data readings is received. In some embodiments, the simplified running characteristic is stored. In some embodiments, the new value of the simplified running characteristic is based on the data reading and on the previous value of the simplified running characteristic. The simplified running characteristic comprises a parameter extracted from the stream of frequent data readings. In various embodiments, the simplified running characteristic is used to determine a trip score, a driver score, a vehicle score, to trigger events, or for any other appropriate purpose. In various embodiments, the simplified running characteristic comprises an average value of data readings, an approximate sum of recent data readings, a filtered stream of data readings, a randomly selected data reading value, or any other appropriate simplified running characteristic. In some embodiments, a trigger level is determined based at least in part on the simplified running characteristic. In some embodiments, a trigger level comprises a level that is compared with a threshold for determining whether to trigger events. In various embodiments, determining a trigger level based at least in part on a simplified running characteristic comprises normalizing the simplified running characteristic, performing linear processing on the simplified running characteristic, performing nonlinear processing on the simplified running characteristic, or processing the simplified running characteristic in any other appropriate way.

In some embodiments, a simplified running characteristic comprises a characteristic calculated over the most recent N readings of a stream of frequent data readings that is updated with every new reading. In some embodiments, a simplified running characteristic is based at least in part on a previous value of the simplified running characteristic, N, and the newest data reading only. In some embodiments, a simplified running characteristic is based at least in part on a previous value of the simplified running characteristic and a finite number of frequent data readings (e.g., 1, 2, 3, 4, 5, 6, 7, 8, 9, 10, K, or any other finite number of frequent data readings, etc.).

FIG. 1 is a block diagram illustrating an embodiment of a system including a vehicle event recorder. In the example shown, vehicle event recorder 102 comprises a vehicle event recorder mounted in a vehicle (e.g., a car or truck). In some embodiments, vehicle event recorder 102 includes or is in communication with a set of sensors—for example, video recorders, audio recorders, accelerometers, gyroscopes, vehicle state sensors, proximity sensors, a global positioning system (e.g., GPS), outdoor temperature sensors, moisture sensors, laser line tracker sensors, or any other appropriate sensors. In various embodiments, vehicle state sensors comprise a speedometer, an accelerator pedal sensor, a brake pedal sensor, an engine revolutions per minute (e.g., RPM) sensor, an engine temperature sensor, a headlight sensor, an airbag deployment sensor, driver and passenger seat weight sensors, an anti-locking brake sensor, an engine exhaust sensor, a gear position sensor, a cabin equipment operation sensor, or any other appropriate vehicle state sensors. In some embodiments, vehicle event recorder 102 comprises a system for processing sensor data and detecting events. In some embodiments, vehicle event recorder 102 comprises map data. In some embodiments, vehicle event recorder 102 comprises a system for detecting risky behavior. In various embodiments, vehicle event recorder 102 is mounted on vehicle 106 in one of the following locations: the chassis, the front grill, the dashboard, the rear-view mirror, or any other appropriate location. In some embodiments, vehicle event recorder 102 comprises multiple units mounted in different locations in vehicle 106. In some embodiments, vehicle event recorder 102 comprises a communications system for communicating with network 100. In various embodiments, network 100 comprises a wireless network, a wired network, a cellular network, a Code Division Multiple Access (CDMA) network, a Global System for Mobile Communication (GSM) network, a Long-Term Evolution (LTE) network, a Universal Mobile Telecommunications System (UMTS) network, a Worldwide Interoperability for Microwave Access (WiMAX) network, a Dedicated Short-Range Communications (DSRC) network, a local area network, a wide area network, the Internet, or any other appropriate network. In some embodiments, network 100 comprises multiple networks, changing over time and location. In some embodiments, different networks comprising network 100 comprise different bandwidth cost (e.g., a wired network has a very low cost, a wireless Ethernet connection has a moderate cost, a cellular data network has a high cost, etc.). In some embodiments, network 100 has a different cost at different times (e.g., a higher cost during the day and a lower cost at night). Vehicle event recorder 102 communicates with vehicle data server 104 via network 100. Vehicle event recorder 102 is mounted to vehicle 106. In various embodiments, vehicle 106 comprises a car, a truck, a commercial vehicle, or any other appropriate vehicle. Vehicle data server 104 comprises a vehicle data server for collecting events and risky behavior detected by vehicle event recorder 102. In some embodiments, vehicle data server 104 comprises a system for collecting data from multiple vehicle event recorders. For example, a vehicle event recorder stores sensor data, derived data, video and/or audio data associated with an event. In some embodiments, vehicle data server 104 comprises a system for analyzing vehicle event recorder data. In some embodiments, vehicle data server 104 comprises a system for displaying vehicle event recorder data. In some embodiments, vehicle data server 104 is located at a home station (e.g., a shipping company office, a taxi dispatcher, a truck depot, etc.). In various embodiments, vehicle data server 104 is located at a colocation center (e.g., a center where equipment, space, bandwidth are available for rental, etc.), at a cloud service provider, or any at other appropriate location. In some embodiments, events recorded by vehicle event recorder 102 are downloaded to vehicle data server 104 when vehicle 106 arrives at the home station. In some embodiments, vehicle data server 104 is located at a remote location. In some embodiments, events recorded by vehicle event recorder 102 are downloaded to vehicle data server 104 wirelessly. In some embodiments, a subset of events recorded by vehicle event recorder 102 is downloaded to vehicle data server 104 wirelessly. In some embodiments, vehicle event recorder 102 comprises a system for a running characteristic for frequent data readings.

Figure 2:
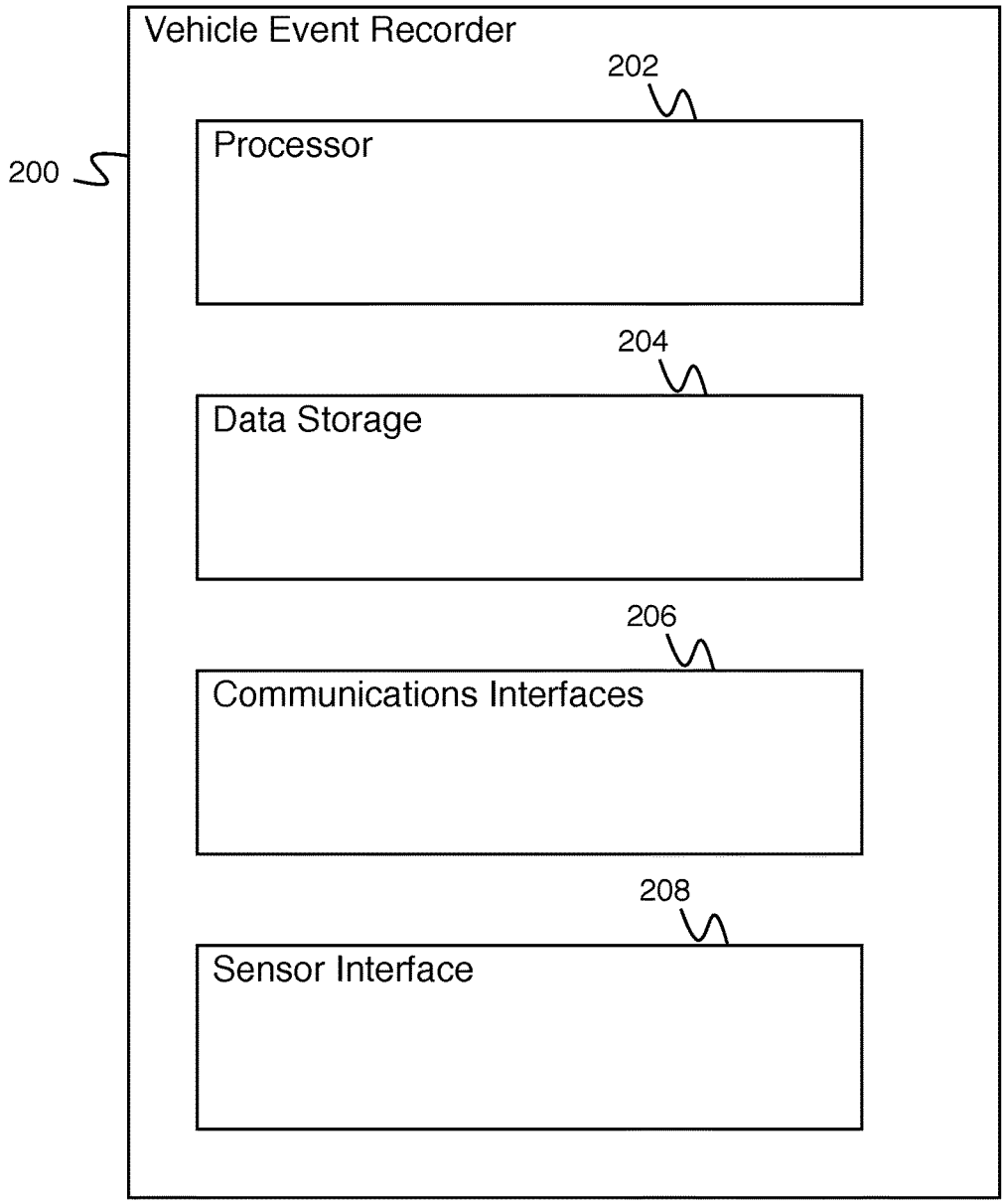
FIG. 2 is a block diagram illustrating an embodiment of a vehicle event recorder.

FIG. 2 is a block diagram illustrating an embodiment of a vehicle event recorder. In some embodiments, vehicle event recorder 200 of FIG. 2 comprises vehicle event recorder 102 of FIG. 1. In the example shown, vehicle event recorder 200 comprises processor 202. Processor 202 comprises a processor for controlling the operations of vehicle event recorder 200, for reading and writing information on data storage 204, for communicating via wireless communications interface 206, and for reading data via sensor interface 208. Data storage 204 comprises a data storage (e.g., a random access memory (RAM), a read only memory (ROM), a nonvolatile memory, a flash memory, a hard disk, or any other appropriate data storage). In various embodiments, data storage 204 comprises a data storage for storing instructions for processor 202, vehicle event recorder data, vehicle event data, sensor data, video data, driver scores, or any other appropriate data. In various embodiments, communications interfaces 206 comprises one or more of a GSM interface, a CDMA interface, a LTE interface, a WiFi™ interface, an Ethernet interface, a Universal Serial Bus (USB) interface, a Bluetooth™ interface, an Internet interface, or any other appropriate interface. Sensor interface 208 comprises an interface to one or more vehicle event recorder sensors. In various embodiments, vehicle event recorder sensors comprise an external video camera, an internal video camera, a microphone, an accelerometer, a gyroscope, an outdoor temperature sensor, a moisture sensor, a laser line tracker sensor, vehicle state sensors, or any other appropriate sensors. In various embodiments, vehicle state sensors comprise a speedometer, an accelerator pedal sensor, a brake pedal sensor, an engine revolutions per minute (RPM) sensor, an engine temperature sensor, a headlight sensor, an airbag deployment sensor, driver and passenger seat weight sensors, an anti-locking brake sensor, an engine exhaust sensor, a gear position sensor, a cabin equipment operation sensor, or any other appropriate vehicle state sensors. In some embodiments, sensor interface 208 comprises an on-board diagnostics (OBD) bus (e.g., society of automotive engineers (SAE) J1939, J1708/J1587, OBD-II, CAN BUS, etc.). In some embodiments, vehicle event recorder 200 communicates with vehicle state sensors via the OBD bus.

FIG. 3 is a diagram illustrating an embodiment of a calculation of a moving average. In some embodiments, the moving average calculation of FIG. 3 is performed by a system for a running characteristic for frequent data readings. In some embodiments, the moving average calculation of FIG. 3 is performed by a vehicle event recorder (e.g., vehicle event recorder 200 of FIG. 2). In the example shown, the moving average calculation of FIG. 3 represents the calculation of a moving average for an input data stream. Data readings comprising the input data stream are received one by one. In various embodiments, data readings comprising the input data stream are received once per microsecond, once per 10 milliseconds, once per second, once per hour, or at any other appropriate rate. In various embodiments, data readings comprising the input data stream represent distance traveled, fuel consumed, number of events detected, number of turns taken, number of times the driver blinks, or any other appropriate sensor data. When a data reading comprising part of the input data stream is received, the moving average is updated.

In some embodiments, assume the following readings of a magnitude a were taken at times t:

$t=t_1, t_2, t_3, t_4, t_5, t_6, t_7, t_8, \ldots, t_m$ $a=a_1, a_2, a_3, a_4, a_5, a_6, a_7, a_8, \ldots, a_m$ where $t_1>t_2>t_3>t_4>t_5>t_6>t_7>t_8> \ldots >t_m$, meaning $t_1$ is the more recent reading and $t_m$ is the oldest, i.e. $t_m$ is the first reading received from the current input data stream. The exact calculation at $t_1$ of the moving average over the last N readings is as follows (Equations A):

$$\text{Average}(t_1, N, m) = (a_1 + a_2 + a_3 + a_4 + \ldots + a_m) \times \frac{1}{m} \text{ (if } m < N)$$

$$\text{Average}(t_1, N, m) = (a_1 + a_2 + a_3 + a_4 + \ldots + a_N) \times \frac{1}{N} \text{ (if } m \geq N)$$

where in the event that m<N means that the current data stream does still not contain the number of data points N requested for the window. Note that the moving average in Equations (A) showing the Average($t_1$, N, m) at $t_1$ can be decomposed as a combination of the moving average previous value, i.e. Average($t_2$, N, m), plus a contribution from the new value $a_1$ and, when m>=N, minus a contribution from the oldest value in Average($t_2$, N, m) which is $a_{N-1}$ as follows (Equations B):

$$\text{Average}(t_1, N, m) = \text{Average}(t_2, N, m) \times \frac{m-1}{m} + a_1 \times \frac{1}{m} \text{ (if } m < N)$$

$$\text{Average}(t_1, N, m) = \text{Average}(t_2, N, m) + a_1 \times \frac{1}{N} - a_{N-1} \times \frac{1}{N} \text{ (if } m \geq N)$$

In the example shown in FIG. 3, an input data stream of a values and the exact moving average calculated over the last 6 measurements, i.e. N=6, are shown.

In various embodiments, the simplified running characteristic is based at least in part on one or more of the following: a previous running characteristic (e.g., Average ($t_2$, N, m)), a sample or an iteration number (e.g., N), a prior sample or a prior iteration number (e.g., $a_1$, $a_2$, $a_3$, $a_4$, $a_m$, N−1, N−2, N−k, etc.), a ratio of i) a prior sample or a prior iteration number and ii) a sample or an iteration number (e.g., $a_1$/(N−1), $a_m$/N, (N−1)/N, (N−2)/N, (N−k)/N, etc.), an inverse of a sample or iteration number (e.g., 1/N), a current or prior input value (e.g., $a_1$, $a_2$, $a_3$, $a_4$, $a_m$, etc.), or any other appropriate value.

FIG. 4 is a diagram illustrating an embodiment of a calculation of an approximate moving average. In some embodiments, the approximate moving average calculation of FIG. 4 is performed by a system for a running characteristic for frequent data readings. In some embodiments, the approximate moving average calculation of FIG. 4 is performed by a vehicle event recorder (e.g., vehicle event recorder 200 of FIG. 2). In the example shown, the approximate moving average calculation of FIG. 4 represents the calculation of an approximate moving average for an input data stream. Data readings comprising the input data stream are received one by one. In various embodiments, data readings comprising the input data stream are received once per microsecond, once per 10 milliseconds, once per second, once per hour, or at any other appropriate rate. In various embodiments, data readings comprising the input data stream represent distance traveled, fuel consumed, number of events detected, number of turns taken, number of times the driver blinks, or any other appropriate sensor data. When a data reading comprising part of the input data stream is received, the approximate moving average is updated. The approximate moving average comprises an approximation of the average of N recent measurements (e.g., 3 recent measurements (N=3), 6 recent measurements (N=6), 20 recent measurements (N=20), 250 recent measurements (N=250), etc.). An accurate value of the average of the N most recent measurements cannot be obtained without storing all N recent measurements (e.g., so each time a new one is added to the total, the oldest can be removed). However, an approximate value can be obtained if in Equations B $a_{N-1}$ is approximated as Average($t_2$, N, m) which gives (Equations C):

$$\textit{ApproximatedAverage}(t_1, N, m) = \textit{ApproximatedAverage}(t_2, N, m) \times \frac{m-1}{m} + a_1 \times \frac{1}{m} \text{ (if } m < N)$$

$$\textit{ApproximatedAverage}(t_1, N, m) = \textit{ApproximatedAverage}(t_2, N, m) \times \frac{N-1}{N} + a_1 \times \frac{1}{N} \text{ (if } m \geq N)$$

Note that ApproximatedAverage($t_1$, N, m)=Average($t_1$, N, m) when m<N.

In some embodiments, the approximated moving average calculation is designed so a new value for the moving average is determined based only on the previous value for the moving average, the number of readings over which the average is calculated (i.e. N), and the new received data reading. The calculation for the new value of the approximated results from scaling the previous value for the moving average by:

$$\frac{N-1}{N},$$

where N is the number of readings over which the average is calculated, and adding to it the received data reading scaled by:

$$\frac{1}{N}.$$

In the example shown in FIG. 4, the same input data stream of a values used in FIG. 3 is considered but now the approximated average value obtained from Equations C for the last 6 measurements is displayed.

In various embodiments, the simplified running characteristic is based at least in part on one or more of the following: a previous running characteristic (e.g., Average ($t_2$, N, m)), a number of data readings (e.g., N), a number based on the data readings (e.g., N−1, N−2, N−k, etc.), a ratio of i) a number based on the data readings and ii) a number of data readings (e.g., $a_1$/(N−1), $a_m$/N, (N−1)/N, (N−2)/N, (N−k)/N, etc.), an inverse of a number of data readings (e.g., 1/L), a current or prior input value (e.g., $a_1$, $a_2$, $a_3$, $a_4$, $a_m$, etc.), or any other appropriate value.

In various embodiments, a running characteristic measures the percent of time a certain condition is satisfied, for example the percent of time the following distance to a forward vehicle is under 20 meters during the last 1 minute, the percent of time driving at least 10 Mph over the posted speed during the last 1 hour, the percent of time the vehicle exhibited braking over the threshold of 0.4 g during the last 30 minutes, the percent of idling time during the last 2 hours, the percent of time the wiper blades were running in the last 30 minutes, or any other appropriate measurement. In a first example the input data stream a contains the distance to the vehicle in front in meters, assuming a sensor reporting that distance at 10 Hz, the last 1 minute is represented by N=600. Here, for each measurement of a, a new feature b is determined that tells whether the following distance is under 20 meters:

$a=a_1, a_2, a_3, a_4, a_5, a_6, \ldots, a_m$=5, 10, 21, 80, NA, 8, . . . , 12

$b=b_1, b_2, b_3, b_4, b_5, b_6, \ldots, b_m$=1, 1, 0, 0, 0, 1, . . . 1

Then, following Equations D, the approximated percent of time that the vehicle followed a forward vehicle at less than 20 meters during the last 1 minute (i.e., ApproximatedPct ($b_1$, N=600,m)) can be determined as a function of the previous estimated percent and the new feature value $b_1$ as follows (Equations D):

$$ApproximatedPct(b_1, N = 600, m) = ApproximatedPct(b_2, N = 600, m) \times \frac{m-1}{m} + b_1 \times \frac{1}{m} \text{ (if } m < 600)$$

$$ApproximatedPct(b_1, N = 600, m) = ApproximatedPct(b_2, N = 600, m) \times \frac{600-1}{600} + b_1 \times \frac{1}{600} \text{ (if } m \geq 600)$$

Here, the percent is returned as a value between 0 and 1. So, for example, an ApproximatedPct=0.33 means that during the last 1 minute 33 percent of the time the vehicle followed another vehicle at less than 20 meters.

In some embodiments, a running characteristic measures the number of times a given situation happened or a condition was met—for example, the number of lane changes performed during the last 5 minutes, the number of right turns during the last 3 hours, the number of road intersections crossed during the last 1 hour, etc. In another example, the input data stream a contains a label "R" when a lane change to the right is being performed, and "L" when a lane change to the left is being performed, and 0 in the event that no lane change is occurring. Assuming the sensor reports this value at 10 Hz, the last 5 minutes are represented by N=3000. Here, for each measurement of a, a new feature b is determined that will tell whether a lane change is being initiated:

$a=a_1, a_2, a_3, a_4, a_5, a_6, \ldots, a_m$=0, R, R, R, R, 0, . . . , 0, 0, 0, 0, 0, 0, L, L, L, L, L, 0

$b=b_1, b_2, b_3, b_4, b_5, b_6, \ldots, b_m$=0, 1, 0, 0, 0, 0, . . . , 0, 0, 0, 0, 0, 0, 1, 0, 0, 0, 0, 0

Then, following Equations D, the approximated number of lane changes during the last 5 minutes (i.e., ApproximatedCount($b_1$, N=3000,m)) can be determined as a function of the previous estimated count and the new feature value $b_1$ as follows (Equations E):

$$ApproximatedCount(b_1, N = 3000, m) = ApproximatedCount(b_2, 3000, m) + b_1 \text{ (if } m < 3000)$$

$$ApproximatedCount(b_1, N = 3000, m) = \text{round}\left(ApproximatedCount(b_2, 3000, m) \times \frac{3000-1}{3000} + b_1\right) \text{ (if } m \geq 3000)$$

In various embodiments, a running characteristic measures a moving standard deviation of frequent data readings—for example, the standard deviation of the vehicle speed over the last 30 seconds, the standard deviation of the forward acceleration above 0.4 g threshold during the last 1 hour, the standard deviation of the last 6 readings of the input data stream whose approximated average was calculated in FIG. 4, or any other appropriate measurement. The standard deviation at time t of the last N readings of a data stream a is exactly calculated as:

$$StDev(t_1, a, N) = \sqrt{\frac{1}{N-1} \times \sum_{i=1}^{N} (a_i - \text{Average}(t_1, a, N))^2}$$

and decomposed as $$StDev(t_1, a, N) = \sqrt{\frac{1}{N-1} \times \left[\sum_{i=1}^{N} a_i^2 - 2 \times \text{Average}(t_1, a, N) \times \sum_{i=1}^{N} a_i + N \times \text{Average}(t_1, a, N)^2\right]}$$

and simplified as $$StDev(t_1, a, N) = \sqrt{\frac{1}{N-1} \times \left[\sum_{i=1}^{N} a_i^2 - N \times \text{Average}(t_1, a, N)^2\right]}$$

$$StDev(t_1, a, N) = \sqrt{\frac{N}{N-1} \times [\text{Average}(t_1, a^2, N) - \text{Average}(t_1, a, N)^2]}$$

With the StDev decomposed as combination of averages, one over a and one over $a^2$, then those averages are approximated as described in FIG. 4, and an approximation of the standard deviation is obtained, where each new value depends on the prior standard deviation and the last data reading:

$$ApproximatedStDev(t_1, a, N) = \sqrt{\frac{N}{N-1} \times [ApproximatedAverage(t_1, a^2, N) - ApproximatedAverage(t_1, a, N)^2]}$$

Figure 5:
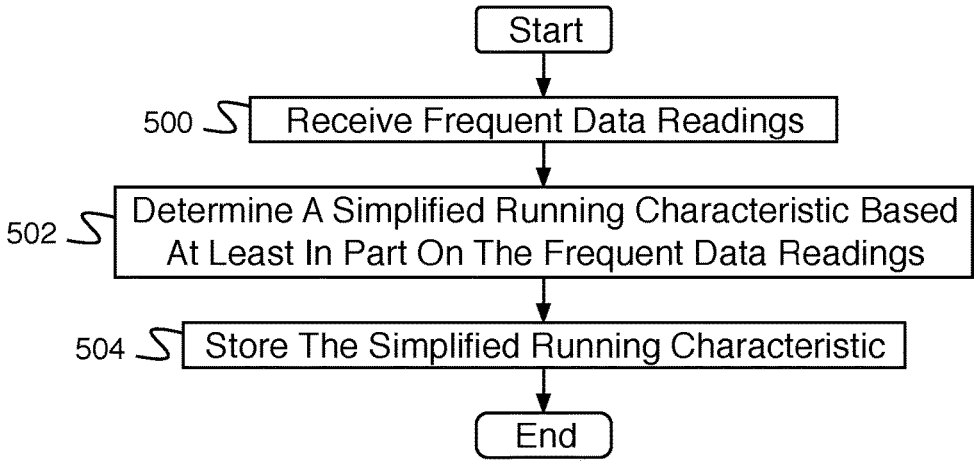
FIG. 5 is a flow diagram illustrating an embodiment of a process for a system for frequent data readings.

FIG. 5 is a flow diagram illustrating an embodiment of a process for a system for frequent data readings. In some embodiments, the process of FIG. 5 is implemented by vehicle event recorder 200 of FIG. 2. In the example shown, in 500, frequent data readings are received. In 502, a simplified running characteristic is determined based at least in part on the frequent data readings. In various embodiments, a simplified running characteristic comprises an average, a sum, a filtered value, a maximum, a minimum, or any other appropriate simplified running characteristic. In 504, the simplified running characteristic is stored. In some embodiments, instructions for the steps of the process of FIG. 5 are stored in a memory and provided for execution by a processor coupled to the memory. In various embodiments, the memory comprises a magnetic memory, a solid-state memory, an optical memory, or any other appropriate memory.

Figure 6:
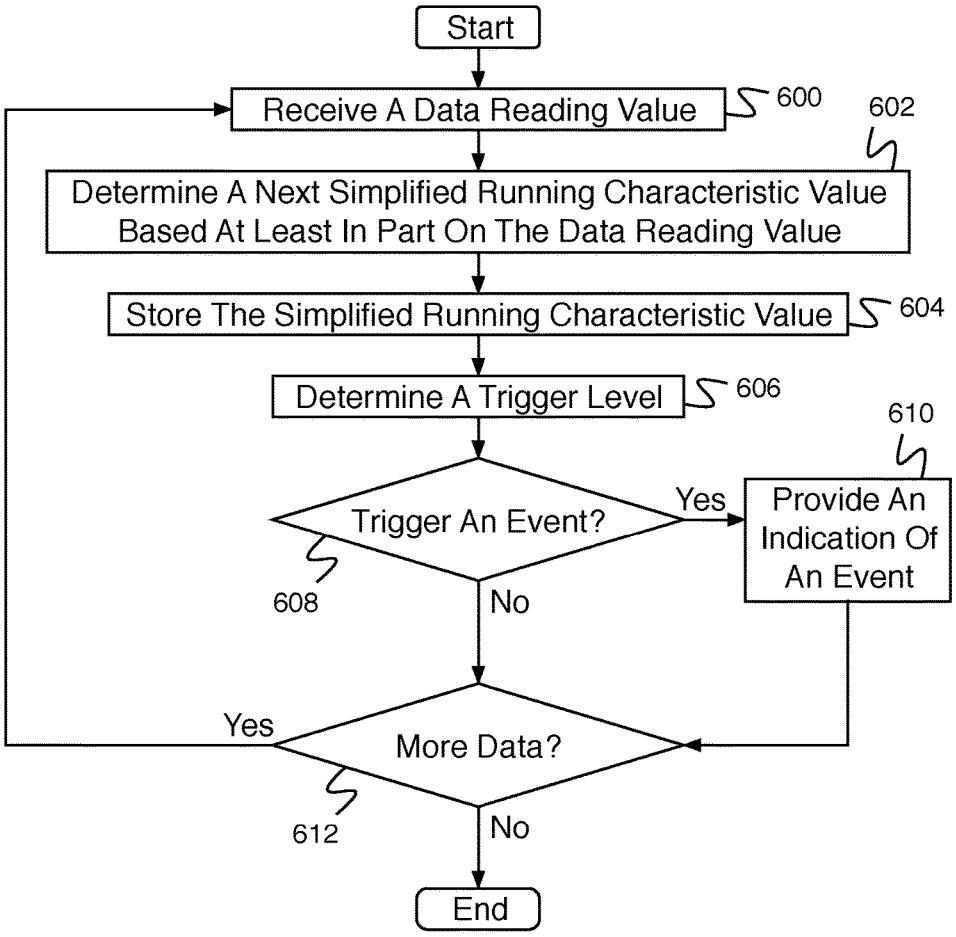
FIG. 6 is a flow diagram illustrating an embodiment of a process for a system for frequent data readings.

FIG. 6 is a flow diagram illustrating an embodiment of a process for a system for frequent data readings. In some embodiments, the process of FIG. 6 is executed by vehicle event recorder 200 of FIG. 2. In some embodiments, the process of FIG. 6 implements the process for a system for frequent data readings of FIG. 5. In the example shown, in 600, a data reading value is received. In some embodiments, the data reading value is received from an input interface. In various embodiments, the data reading value comprises a sensor data value, a GPS data value, a vehicle state value, a value extracted from an image sensor, a value extracted from an audio sensor, a raw data value, a processed data value, or any other appropriate data value. In 602, a next simplified running characteristic value is determined based at least in part on the data reading value. In various embodiments, a simplified running characteristic comprises one or more of the following: an average, a sum, a percentage, a count, a standard deviation, or any other appropriate characteristic. In some embodiments, a next simplified running characteristic value is determined based at least in part on the data reading value and a previous value of the simplified running characteristic. In some embodiments, a next simplified running characteristic comprises a single value. In some embodiments, a next simplified running characteristic comprises a predetermined set of values (e.g., a set of values of a predetermined size, e.g., 3 values, 7 values, etc., each of which is updated when a next simplified running characteristic value is determined). In 604, the simplified running characteristic value is stored. In some embodiments, storage space is limited. In some embodiments, the simplified running characteristic is uploaded (e.g., transferred to a remote computer e.g., vehicle data server 104 of FIG. 1). In some embodiments, an environment value is determined based at least in part on the simplified running characteristic. In various embodiments, an environment value is used to determine a trigger level, a processing parameter, a driver environment value (e.g., driver preferred temperature, driver preferred radio volume), a vehicle environment value (e.g., appropriate shocks stiffness or height, appropriate idle level, etc.), or any other appropriate value. In some embodiments, a driver profile value (e.g., a driver safety profile value, a driver efficiency profile value, a driver speed profile value, a driver happiness profile value, a driver coaching value, etc.) is determined based at least in part on the simplified running characteristic. In 606, a trigger level is determined. In some embodiments, a trigger level is determined based at least in part on the simplified running characteristic. In various embodiments, a trigger level is determined by normalizing the simplified running characteristic, linearly processing the simplified running characteristic, nonlinearly processing the simplified running characteristic, combining the values of the simplified running characteristic, or a trigger level is determined in any other appropriate way. In some embodiments, a trigger level comprises a value used for determining whether to trigger an event. In 608, it is determined whether to trigger an event. In some embodiments, it is determined whether to trigger an event by comparing the trigger level to a threshold. In some embodiments, the threshold comprises a fixed threshold. In some embodiments, the threshold comprises an adaptable threshold. In various embodiments, the threshold adapts based on driver behavior, vehicle performance, traffic conditions, weather conditions, time of day, or any other appropriate characteristics. In the event it is determined not to trigger an event, control passes to 612. In the event it is determined to trigger an event, control passes to 610. In 610, an indication of an event is provided. Control then passes to 612. In 612, it is determined whether there is more data (e.g., whether data readings are still being received). In the event it is determined that there is more data, control passes to 600. In the event it is determined that there is not more data, the process ends.

Figure 7:
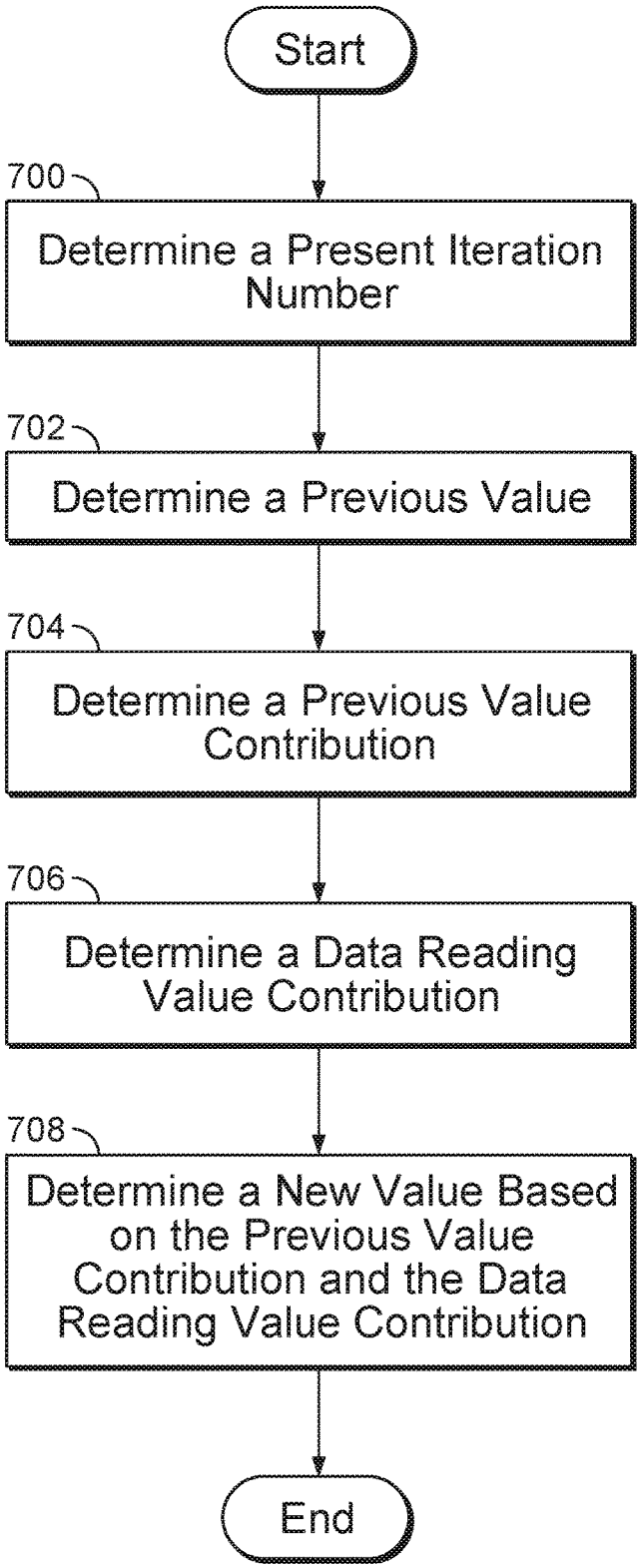
FIG. 7 is a flow diagram illustrating an embodiment of a process for determining a next simplified running characteristic based at least in part on a data reading value.

FIG. 7 is a flow diagram illustrating an embodiment of a process for determining a next simplified running characteristic based at least in part on a data reading value. In some embodiments, the process of FIG. 7 implements 602 of FIG. 6. In the example shown, the process of FIG. 7 implements a calculation of an approximated moving average (e.g., a calculation of a moving average as shown in FIG. 4). In 700, a present iteration number is determined. In some embodiments, a present iteration number is determined by incrementing a previous iteration number. In 702 a previous value is determined. In some embodiments, a previous value is determined by recalling a stored previous value. In 704, a previous value contribution is determined. In 706, a data reading value contribution is determined r. In 708, a new value is determined based at least in part on the previous value contribution and the data reading value contribution. In various embodiments, an average, a sum, a percentage, a count, a standard deviation, or any other appropriate value are determined based on appropriate calculations. For example, an average value is determined as described with respect to FIG. 3. As another example, a percentage value is determined as described with respect to FIG. 4. As another example, a count is determined as described with respect to Equations D. As another example, a standard deviation is determined as described with respect to Equation E.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A system for frequent data readings, comprising:

an input interface to receive frequent data readings, wherein the frequent data readings comprise a newest data reading; and a processor to:

determine a current value of a simplified running characteristic based at least in part on the newest data reading and a previous value of the simplified running characteristic;

store the current value of the simplified running characteristic; and determine a trigger level based at least in part on the current value of the simplified running characteristic.

2. The system of claim 1, wherein the current value of the simplified running characteristic comprises a single value.

3. The system of claim 1, wherein the current value of the simplified running characteristic comprises a predetermined set of values within a rolling window.

4. The system of claim 1, wherein the processor is further to determine whether to trigger an event.

5. The system of claim 4, wherein the event has associated sensor data, derived data, video data and/or audio data.

6. The system of claim 4, wherein the determination of whether to trigger an event is based at least in part on the trigger level.

7. The system of claim 4, wherein the determination of whether to trigger an event is based at least in part on a trigger threshold.

8. The system of claim 1, wherein the processor is further to upload the current value of the simplified running characteristic.

9. The system of claim 1, wherein the processor is further to determine an environment value based at least in part on the current value of the simplified running characteristic.

10. The system of claim 1, wherein the processor is further to determine a driver profile value based at least in part on the current value of the simplified running characteristic.

11. The system of claim 1, wherein the determination of the current value of the simplified running characteristic comprises an exact calculation.

12. The system of claim 1, wherein the determination of the current value of the simplified running characteristic comprises an approximate calculation.

13. The system of claim 1, wherein the current value of the simplified running characteristic comprises one or more of the following: an average, a sum, a percentage, a count, or a standard deviation.

14. The system of claim 1, wherein the frequent data readings comprise sensor data readings.

15. The system of claim 1, wherein the frequent data readings comprise vehicle data readings.

16. The system of claim 1, wherein the current value of the simplified running characteristic comprises a vehicle parameter.

17. The system of claim 1, wherein the current value of the simplified running characteristic comprises a driver parameter.

18. The system of claim 1, wherein the determination of the current value of the simplified running characteristic is based at least in part on the previous value of the simplified running characteristic and the newest data reading only.

19. The system of claim 1, wherein the newest data reading is not retained after a next data reading of the frequent data readings is received.

20. A method for frequent data readings, comprising:

receiving frequent data readings, wherein the frequent data readings comprise a newest data reading; and determining, using a processor, a current value of a simplified running characteristic based at least in part on the newest data readings and a previous value of the simplified running characteristic;

storing the current value of the simplified running characteristic; and determining, using the processor, a trigger level based at least in part on the current value of the simplified running characteristic.

21. A computer program product for frequent data readings, the computer program product being embodied in a non-transitory computer readable storage medium and comprising computer instructions for:

receiving frequent data readings, wherein the frequent data readings comprise a newest data reading; and determining a current value of a simplified running characteristic based at least in part on the newest data readings and a previous value of the simplified running characteristic;

storing the current value of the simplified running characteristic; and determining a trigger level based at least in part on the current value of the simplified running characteristic.

* * * * *